United States Patent [19]

Carmichael et al.

[11] 4,050,564

[45] Sept. 27, 1977

[54] ELECTRONIC CONTROL FOR OPTIMIZING CARRIER TURNAROUND IN PRINTING APPARATUS

[75] Inventors: John Michael Carmichael, Nicholasville; James David Hill; Donald Lee West, both of Lexington, all of Ky.

[73] Assignee: International Business Machines Corporation, Armonk, N.Y.

[21] Appl. No.: 637,706

[22] Filed: Dec. 4, 1975

Related U.S. Application Data

[63] Continuation of Ser. No. 418,797, Nov. 23, 1973, abandoned.

[51] Int. Cl.[2] ..... B41J 1/00

[52] U.S. Cl. ..... 197/1 R; 197/65; 197/82; 346/75; 346/139 B

[58] Field of Search ..... 197/1 R, 19, 65, 66, 197/67, 68, 82; 346/75, 139 R, 139 A, 139 B, 139 C, 139 D

[56] References Cited

U.S. PATENT DOCUMENTS

| | | | |
|---|---|---|---|
| 3,060,429 | 10/1962 | Winston | 197/1 R UX |
| 3,292,530 | 12/1966 | Martin | 197/1 R X |
| 3,298,030 | 1/1967 | Lewis et al. | 346/75 |
| 3,400,798 | 9/1968 | Smith | 197/1 R |
| 3,403,386 | 9/1968 | Perkins et al. | 197/82 UX |
| 3,432,844 | 3/1969 | Winston | 197/1 R UX |
| 3,459,287 | 8/1969 | Avins et al. | 197/1 R |
| 3,465,350 | 9/1969 | Keur et al. | 346/75 |
| 3,519,118 | 7/1970 | Reszka | 197/1 R X |
| 3,710,913 | 1/1973 | Brennan et al. | 197/65 UX |
| 3,713,523 | 1/1973 | Niemietz | 197/19 |
| 3,787,880 | 1/1974 | Kattner et al. | 197/1 R X |
| 3,787,884 | 1/1974 | Demer | 197/1 R X |
| 3,805,274 | 4/1974 | Kashio | 346/75 |
| 3,831,728 | 8/1974 | Woods et al. | 197/19 X |

*Primary Examiner*—Ernest T. Wright, Jr.
*Attorney, Agent, or Firm*—Frank C. Leach; William J. Dick

[57] ABSTRACT

Printing apparatus has an ink jet printhead mounted on a carrier for movement during printing of characters between left and right margin locations relative to a document. A directionally oriented grating and associated circuitry is provided to maintain a record of character and ink drop printing locations. The printhead begins its movement prior to the left margin location and sweeps toward the right margin for printing of an entire line of characters. Thereafter, the printhead is returned to the aforesaid position prior to the left margin in readiness for another line sweeping action. Provision is made for testing carrier velocities encountered in movement to the right during printing as well as to the left during carrier return and for determining optimum times of operation of the carrier return magnet and its release in order to reduce time required for carrier turnaround.

10 Claims, 6 Drawing Figures

FIG. 1
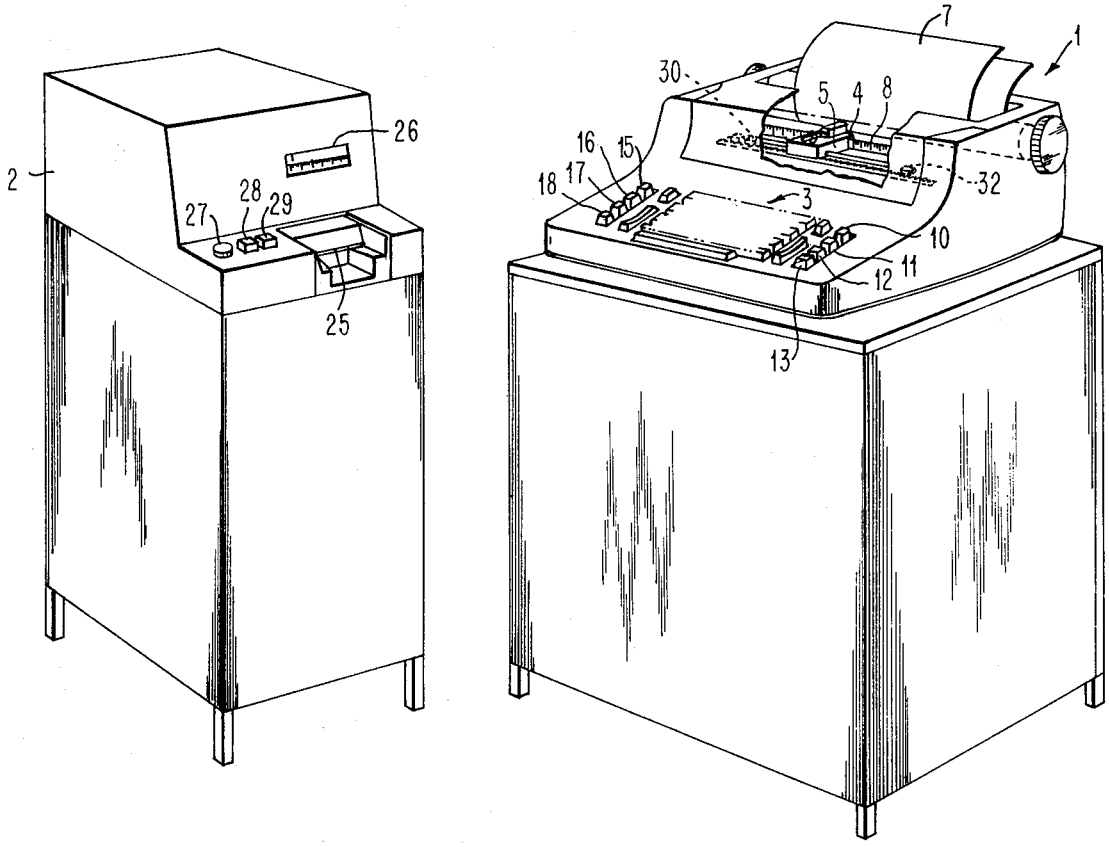
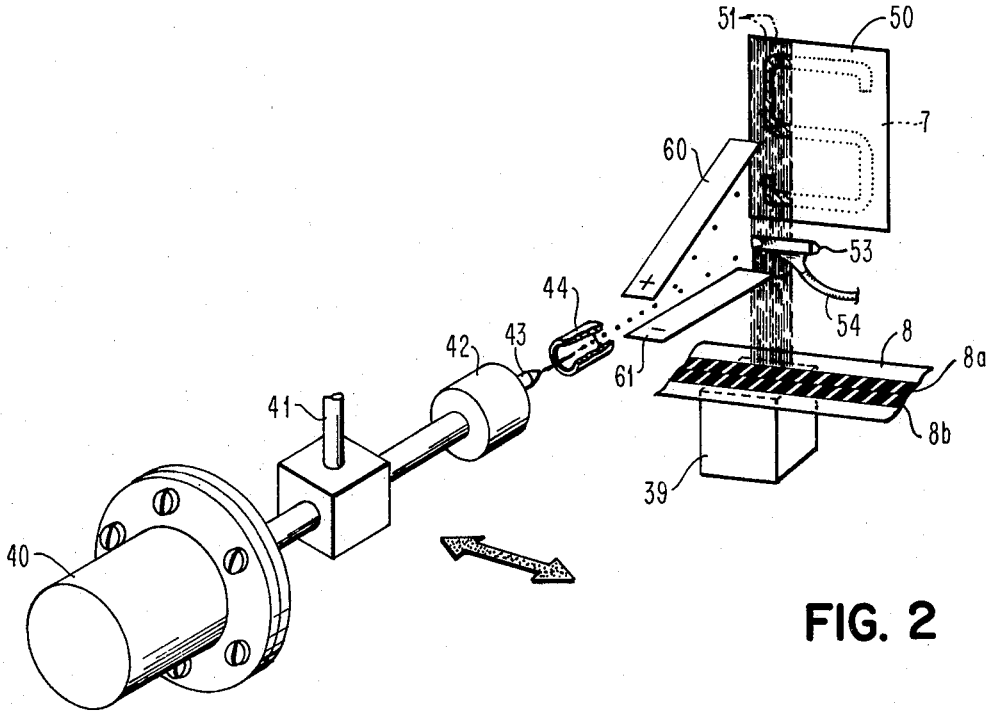
FIG. 2

ELECTRONIC CONTROL FOR OPTIMIZING CARRIER TURNAROUND IN PRINTING APPARATUS

CROSS REFERENCE TO RELATED APPLICATION

This is a continuation of copending application Ser. No. 418,797, filed Nov. 23, 1973, now abandoned.

BACKGROUND OF THE INVENTION AND PRIOR ART

Typical of the prior art is the printing apparatus described in U.S. patent application Ser. No. 313,886, now U.S. Pat. 3,831,728, entitled "Ink Jet Printing Apparatus With Overrun Of Printhead To Insure Better Visibility And Counter Control Of Printing Locations," filed Dec. 11, 1972, and having J. W. Woods and K. Yosmali as inventors. In the Woods et al Pat. No. 3,831,728, which is specifically incorporated by reference herein, an ink jet printer is described that has provision for both line printing and character-by-character, that is, incremental printing.

SUMMARY OF THE INVENTION

Provision is made in an ink jet printing apparatus for determining the velocities of a carrier on which an ink jet printhead is mounted for movement between left and right margins in relation to a document to be printed, the carrier moving in one direction, that is, to the right, during printing of a complete line of characters, and in the opposite direction, to the left, during a carrier return operation. The carrier return operation is under control of a carrier return magnet and the system includes controls for energizing and de-energizing the magnet at predetermined optimum times during carrier movement in order to reduce the amount of time required for carrier turnaround at the left margin and thereby to effectively increase efficiency of the system and throughput of printing. Throughput of printing is the amount of characters that can be printed in a given period of time while the efficiency of the system increases as the left margin can be moved closer to the frame to increase the length of the writing line. The carrier turnaround time represents non-productive time, and reduction of time for that purpose increases the time available for printing, that is, the productive time of the system.

OBJECTS

Accordingly, the primary object of the present invention is to provide an ink jet printing apparatus that operates in a more efficient and productive manner than has been possible heretofore by optimization of non-productive mechanical operations, such as movement of the ink jet printhead carrier.

The foregoing and other objects, features, and advantages of the invention will be apparent from the following more particular description of the preferred embodiment of the invention as illustrated in the accompanying drawing.

DRAWING

In the drawing:

FIG. 1 illustrates an ink jet printing system incorporating a printer and having an associated magnetic card recording/reproducing unit.

FIG. 2 illustrates structures in the ink jet printer head assembly with associated grating.

Figure 4A:
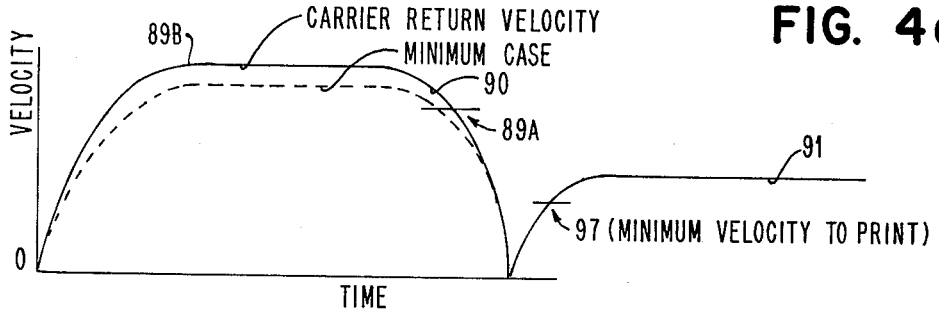
Figure 4B:
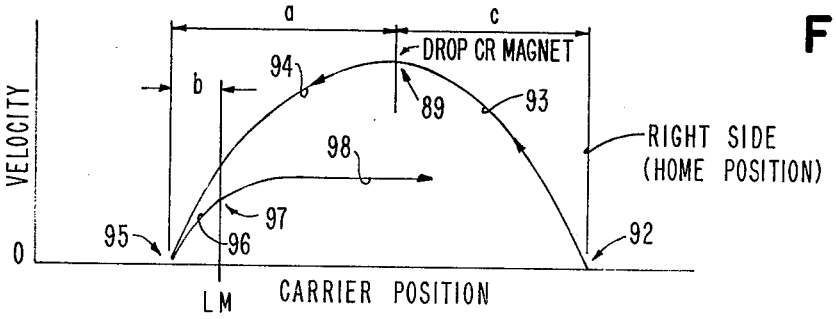

FIGS. 4*a* and 4*b* represent timing, positional, and velocity considerations in the system.

Figure 5:
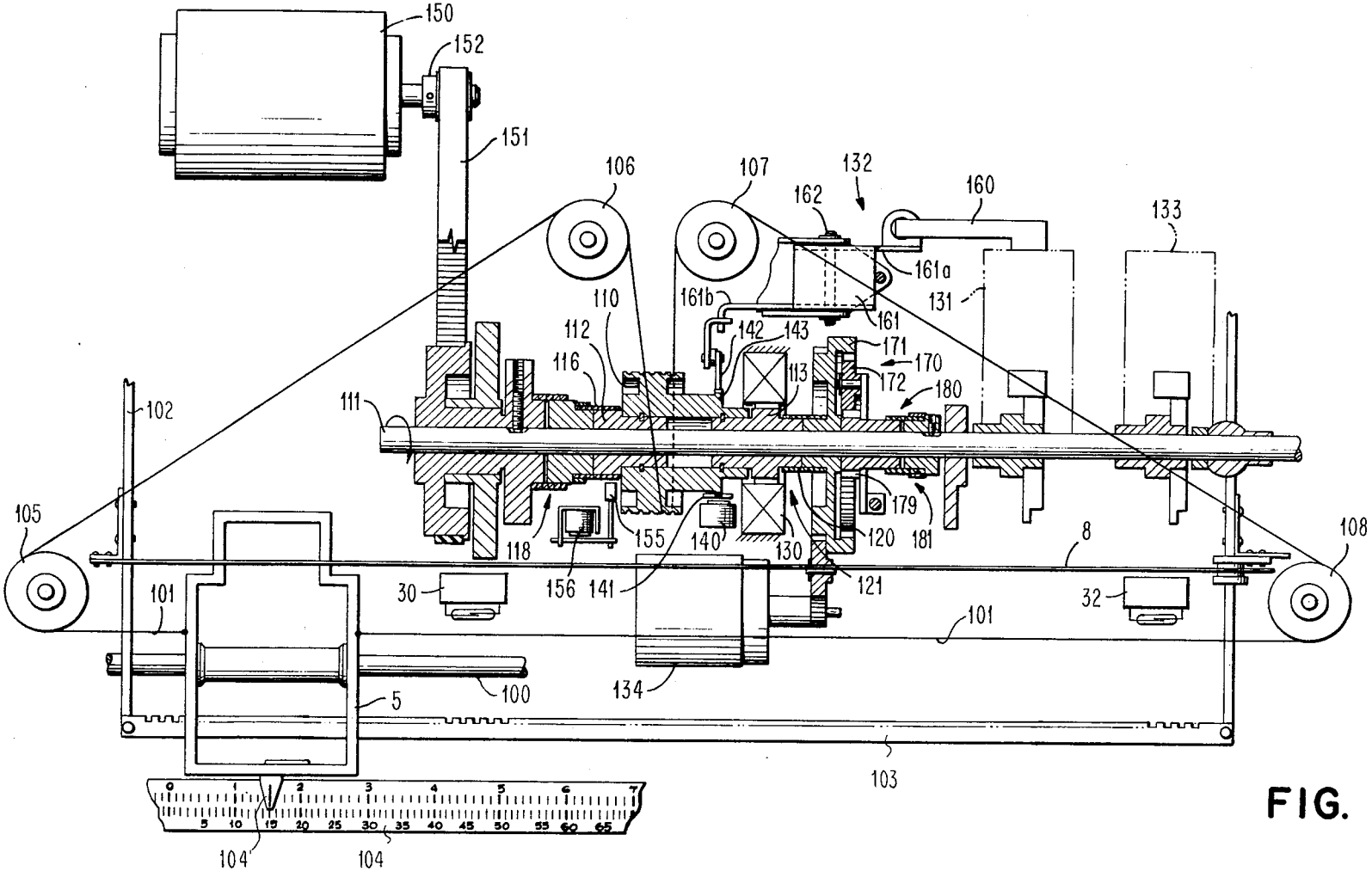

FIG. 5 illustrates various mechanisms involved in producing relative motion of the ink jet head and carrier assembly in relation to a document to be printed.

DETAILED DESCRIPTION

FIG. 1 illustrates an ink jet printing system incorporating a printer 1 with an associated magnetic card recording/reproducing unit 2. The card unit 2 is shown for convenience only and it is apparent that other kinds of storage units, recording/reproducing units, processors, and the like may be used in the system. The printer 1 has the usual keyboard 3 which preferably is of the electrical type referred to in the Woods et al case.

The printer 1 incorporates an ink jet head assembly 4 mounted on a carrier 5 and arranged for travelling movement from left to right (and conversely) adjacent a document 7 to be printed. The assembly 4 has an ink drop nozzle 43 and an associated grating 8 for keeping track of the horizontal location of the carrier 5, these members being shown in greater detail in FIG. 2.

The printer 1 may be provided with various control buttons 10, 11, 12, and 13 for automatic, line, word, and character printing, respectively. Other keybuttons 15–18 concern mode selection, that is, record, playback, adjust, and skip, respectively.

The magnetic card unit 2 has a load slot 25 and a track indicator 26. Also provided on the unit 2 is a card eject button 27, a track stepdown button 28, and a track stepup button 29 for relocating a scanning transducer (not shown) with respect to a magnetic card when positioned internally in the unit 2 for scanning. Reference is made to the Jones et al U.S. Pat. No. 3,512,137 for a description of typical facilities in a card unit of this nature. A magnetic tape unit such as that in the Sims U.S. Pat. No. 3,297,124 could also be used in the present system.

The printer 1 incorporates a drop carrier return reed switch 30 and a right margin reed switch 32, also shown in FIG. 5. Both the reed switch 30 and the reed switch 32 are fixed with the reed switch 30 being at a known position. The right margin reed switch 32 determines the right hand limit of printing in any line.

Referring to FIG. 2, various structures incorporated in the head assembly 4 are illustrated. This includes a pump 40 for directing ink from an ink supply conduit 41 on demand as a crystal 42 is energized, that is, pulsed at high frequencies. The rate of impulsing the crystal 42 may be in the range of 100 kiloHertz, for example.

Ink drops are emitted from the nozzle 43 and pass through a charge electrode 44 for variable charging in accordance with the output of a charge amplifier (not shown) to deflect the drops in a column an amount representing the vertical height of the drop location in any given character. As illustrated, the letter capital "S" designated 50 comprises a number of vertical columns 51. The printing is such that a sequence of vertical columns, each comprising a plurality of drops, such as 40 in number, is propelled from the nozzle 43 to the document 7 for the printing of the character involved. If drops are not required for printing, they are customarily directed to a gutter 53 for passage by means of a conduit 54 back to the ink supply.

A pair of deflection plates 60 and 61 is positioned in the path of travel of the drops leaving the charge electrode 44. A constant high potential is applied across the plates 60 and 61 and this in conjunction with the variable charge on the individual drops determines the amount of deflection as the drops are directed toward the document 7.

A grating 8 in this instance is shown as being positioned horizontally rather than vertically as in FIG. 1, but the positioning is immaterial. The grating 8 has two portions 8*a* and 8*b*.

Mounted on the head assembly 4 for translational movement adjacent the grating 8 is a sensor assembly 39 incorporating a light emitting diode (not shown) arranged to direct light through the grating 8 and a master grating to a pair of solar cells, the diode, master grating, and solar cells being more fully shown in the Woods et al U.S. Pat. No. 3,831,728, which is incorporated herein by reference. As described therein, output of the grating assemblies in conjunction with an up-down counter enables accurate determination of the horizontal location of the carrier 5 and the head assembly 4 relative to the document 7, each count representing a particular one of the columns 51.

If it is assumed that the printer 1 is in a line mode and the system is in a playback mode, appropriate positioning of a card (not shown) results in the card unit 2 furnishing signals to the printer 1 to initiate the printing of characters. An output indicating "print" is provided and remains at an up level until an end of line signal is received from the card unit 2.

TRANSPORT MECHANISMS FOR RELATIVELY MOVING CARRIER AND DOCUMENT

FIG. 5 illustrates various transport structures derived from the Woods et al U.S. Pat. No. 3,831,728 and incorporated in the present apparatus that enable line printing, character-by-character incremental printing, and carrier return operations, as well as tabulation operations, backspacing operations, and the like.

The carrier 5 is mounted for travelling movement from left to right adjacent the document 7 on a shaft 100, which is supported in a left frame 102. The left frame 102 also has one end of an escapement rack 103 connected thereto. A scale 104 is disposed for cooperation with a pointer 104' on the carrier 5. Attached on either side of the carrier 5 is a cable 101 that is illustrated as passing around pulleys 105–108 in FIG. 5.

The cable 101 is wound on a cord drum 110. The cord drum 110 is mounted on an operational shaft 111. Associated with the drum 110 is a hub member 112, fixedly mounted therewith, and another hub member 113, the entire assembly of the elements 110, 112, and 113 being freely mounted on the shaft 111.

Surrounding the hub member 112 is a spring element 116 forming part of a spring clutch assembly 118, while surrounding a portion of the hub member 113 is a spring element 120 forming part of a spring clutch assembly 121, which disengages a planetary gear system 170 comprising a ring gear 171, a planetary gear 172, and a sun gear 179 during carrier return operations to prevent gear noise. The clutch assembly 118 is involved in carrier return operations, that is, movement of the carrier 5 from right to left in the printer 1 while a spring clutch 181 is involved in a governing action when the carrier 5 is moved from left to right in the tab or forward spacing direction.

Other primary structures associated with the transport mechanisms include a main spring 130, a backspace clutch assembly 131 and associated elements arranged in a train for mechanical control designated 132, an index assembly 133, and a tab governor 134.

It is assumed that the carrier 5 is at the left margin location. If printing of a line is desired, a backspace operation is first anticipated by the assembly 131, and pawls 141 and 142 shown more particularly in FIG. 5 are disengaged from a ratchet 143. This enables driving movement by the main spring 130 through the hub member 113 and the cord drum 110 to pull the cable 101 and the carrier 5 in a direction from left to right in relation to the document 7.

Movement of the carrier 5 continues until a line ending code is received from the data source or the reed switch 32 is encountered indicating the right margin. Thereupon, a carrier return drive is initiated from a motor 150, a pulley 152, and a belt 151 and is coupled through the hub element 112 and the cord drum 110 by engagement of the spring element 116 of the clutch assembly 118 by means of a shoe 155 activated by a carrier return magnet 156. Accordingly, the carrier 5 is moved from right to left in the carrier return direction until the left margin is encountered indicating termination of the carrier return operation. While the carrier 5 is in operation, the main spring 130 is being wound up in preparation for escapement and tabulation movements in a succeeding line.

As described in the Woods et al U.S. Pat. No. 3,831,728, the carrier 5 at the outset is to the right of a character location to be printed. Printing of an individual character, that is, incremental printing involves backspacing of the carrier 5 (to the left) prior to the character position desired and then driving the carrier 5 forward (to the right) in a sweeping movement through and beyond the character position stopping again to the right of the next character position, thereby obtaining better visibility of the printing line.

The logic in the Woods et al U.S. Pat. No. 3,831,728 is operative to initiate a backspacing operation of 0.3 inch corresponding to three characters, assuming a 10 pitch character increment. The backspacing operation is initiated by energization of the backspace clutch 131 which by means of an actuator 160 moves an arm assembly 161 pivotally mounted on a pivot 162. The arrangement is such that a portion 161*a* moves into FIG. 5, that is, away from the viewer, while a portion 161*b* moves upwardly from the surface of FIG. 5, that is, toward the viewer. The motion of the member 161 is such that the pawl 142 moves the ratchet 143 in a counterclockwise direction when viewed from the right end of the shaft 111. The ratchet 143 is directly associated with the cord drum 110 and this effects movement of the carrier 5 three character spaces back.

Thereafter, an escapement magnet 140 is energized to release the ratchet 143 so that the cord drum 110 may be moved in a clockwise direction as viewed from the right end of the shaft 111 under influence of the main spring 130.

During any tabulation movement under influence of the main spring 130, speed of the movement is controlled by the tab governor 134 by means of the planetary gear system 170 comprising the ring gear 171, the planetary gear 172, and the sun gear 179. The control is exerted through the spring clutches 121 and 180 as well as the governor 134 to insure that excessive speeds are not encountered.

Figure 3:
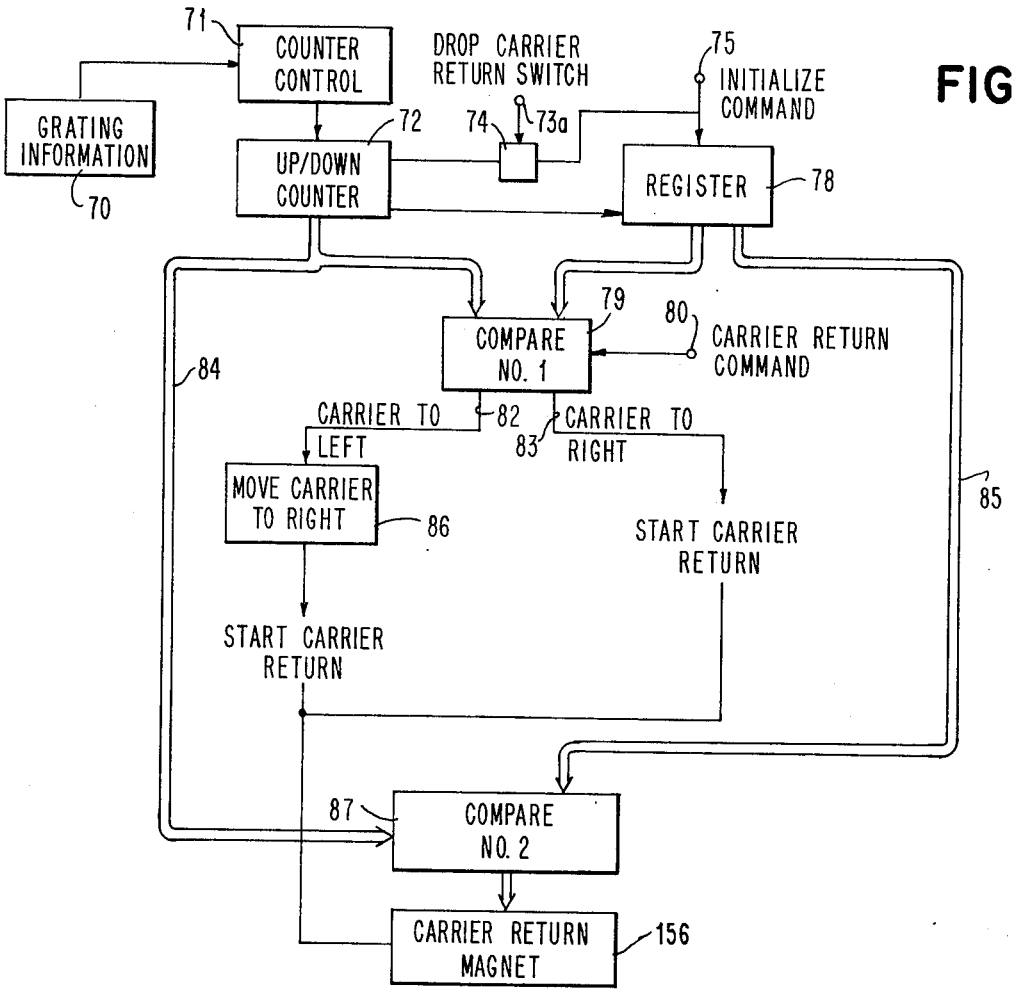
FIG. 3 represents a block diagram of the ink jet printing system incorporating circuitry for optimizing carrier return movements during the test cycle and print cycles.

With activation of the main spring 130 and rotation of the cord drum 110, the carrier 5 and the head assembly 4 move in a left to right direction with the electronics (see FIG. 3*a* of the Woods et al U.S. Pat. No. 3,831,728 controlling the printing of a character in the character box, such as the "S" in FIG. 2, as required, taking into account the character and columnar positions of ink drops by monitoring of the grating 8 (FIG. 2) and an associated counter 72 (FIG. 3) during movement of the carrier 5. The escapement magnet 140 is de-energized in time for the carrier 5 to stop beyond the character just printed.

Succeeding characters are printed in the incremental mode in this manner as long as required.

The line printing mode provides for successive continuous sweeping of the carrier 5 from prior to the left margin to the right margin on a line-by-line basis and a carrier return of the carrier 5 following printing of each line, the printing of lines normally not involving the backspacing/forward movement of the carrier 5 step by step as described for incremental printing.

FIG. 3 shows the block diagram of the electronics used to determine the carrier return magnet drop point during a Test cycle and to control the carrier return magnet drop point during a carrier return function in a print cycle. FIG. 4*a* shows a carrier return profile 90 expected during normal carrier return operation, the carrier 5 accelerating, then stabilizing, then decreasing. Also shown at 91 is a velocity profile expected during printing.

FIG. 4*b*, also having a velocity profile, shows the minimum requirements necessary to guarantee that the carrier 5 achieves a minimum velocity during carrier return to insure validity of the electronic control estimation scheme throughout the entire print line. As shown in FIG. 4*b*, the minimum carrier return requirements involve three primary intervals, *a*, *b*, and *c*. Interval "*a*" is the deceleration portion of the carrier return function. Interval "*c*" of FIG. 4*b* is the acceleration portion of the carrier return function to a point 89 in FIG. 4*b*. It should be understood that the acceleration portion of the carrier return function in FIG. 4*a* could end at point 89A, for example, whereby the carrier return profile 90 would not be the same as shown in FIG. 4*a* and that this would require a different circuit than FIG. 3. Interval "*b*" of FIG. 4*b* is the forward velocity profile of the carrier 5 prior to reaching the first print position, so that this is the opposite direction of the carrier 5 to its motion during movement through the intervals "*c*" and "*a*" whereby the interval "*b*" is represented by a negative number when the intervals "*c*" and "*a*" are represented by positive numbers. It should be understood that the CARRIER POSITION in FIG. 4*b* is not related to any specific position of the carrier 5 in FIG. 5 but merely shows the relative positions of the carrier 5 for different distances that it travels.

As shown in FIG. 4*b*, a carrier return operation begins with movement to the left at a point 92 and velocity increases along a slope 93. The carrier return magnet 156 is dropped at the point 89 (It should be understood that the carrier return magnet drop point is shown at 89B in FIG. 4*a*.) and velocity decreases to zero along a slope 94 to a point 95. Carrier direction changes toward the right and velocity increases along a profile portion 96 to a "minimum velocity to print" condition at a point 97 (FIGS. 4*a* and 4*b*). Thereafter, velocity levels off along the profile portion 91 in FIG. 4*a* and profile portion 98 in FIG. 4*b*.

The carrier return estimation scheme is based on estimating the portion of the velocity profile represented by interval "*a*" of FIG. 4*b*. Interval "*c*" of the velocity profile in FIG. 4*b* and also interval "*b*" are both fixed numbers. The difference between intervals "*c*" and "*b*" of FIG. 4*b* is programmed into a register 78 (FIG. 3). This number represents a number of grating pulses which translates to a mechanical distance that the carrier 5 can travel during the carrier return function. This number is loaded into the register 78 when the register 78 is initialized by a command at a terminal 75 of FIG. 3. Initialization occurs during a Power On procedure for the system. The negative number for the interval "*b*" also is stored in the register 78, which can be any register capable of storing two numbers, separately from the difference between "*c*" and "*b*." This number also is loaded into the register 78 when the register 78 is initialized by a command at the terminal 75 of FIG. 3.

Immediately following the Power On procedure, the carrier 5 is moved into a Test cycle. The purpose of this Test cycle is to measure interval or portion "*a*" of FIG. 4*b*, so that this information added to the initialized number which is the negative of the number for interval "*b*" in the register 78 will permit estimation of the carrier return magnet drop point for all future carrier returns until another Test cycle is performed and this information added to the initialized number which is "*c*" - "*b*" in the register 78 will permit determination as to whether the carrier 5 is to the left or to the right of the minimum carrier return distance necessary to insure sufficient velocity in order to be able to use the carrier return estimation scheme until another Test cycle is performed. At the time of the next Test cycle, the number representing interval "*a*" of FIG. 4*b* will be updated.

In FIG. 3, grating information at a block 70 comes from the grating 8 (FIG. 2). The grating information, which the block 70 receives from the grating 8, is the information supplied at the outputs of amplifiers 70 and 73 in FIG. 5*b* of the Woods et al U.S. Pat. No. 3,831,728. This grating information then enters through a counter control 71 (FIG. 3) into an up-down counter 72. The counter control 71 comprises the And-Invert blocks 71 and 74 of FIG. 5*b* of the Woods et al case.

The counter control 71 determines when the up-down counter 72 should be incremented or decremented, depending on the forward or reverse travel of the carrier 5. This is done since the counter 72 always needs to contain the grating count which represents the present carrier position.

Reference is made to the article entitled "Counting Scheme For Incremental Encoders" by H. Portig in the IBM Technical Disclosure Bulletin, Vol. 16, No. 3, August, 1973, Pp. 799–803. This article discusses how the counter control 71 functions to determine when the counter 72 should be incremented or decremented.

During the Test cycle, the up-down counter 72 is started when a shunt 74 of FIG. 3 passes the drop carrier return switch 30 of FIG. 5 which initializes the up-down counter 72 by input to a terminal 73*a* (FIG. 3). The relation of a reed switch and a shunt is described on page 512 of the October 1966 issue of the IBM Technical Disclosure Bulletin in an article by R. L. Burdick et al. The shunt 74, which is mounted for movement with the carrier 5, functions to activate the drop carrier return switch 30 through causing it to open when the shunt 74 is at the switch 30 so that an input is provided to the terminal 73*a*. This synchronizes the counter 72 with the location of the switch 30. That is, this enables the counter 72 to have its count correspond to the known location of the switch 30. While the shunt 74 passes the drop carrier return switch 30 during all cycles, the output of the switch 30 supplies an input to the terminal 73*a* only during a Test cycle.

After being initialized, the up-down counter 72 continues to count until the carrier 5 reaches zero velocity, at which time this number of grating pulses is transferred to the register 78 of FIG. 3. The register 78 now contains the number, which is the interval "*a*", to be used for all future carrier return functions.

The output of the register 78 is then transmitted to a Compare No. 1 logic comparator 79 of FIG. 3. An example of the comparator 79 is a fully clamped voltage comparator shown on page 46 of Handbook Of Operational Amplifier Applications by Burr-Brown Research Corporation, copyright 1963.Upon receipt of a signal at a terminal 80 to start a carrier return function during a print cycle, the Compare No. 1 logic comparator 79 is used to determine whether the carrier 5 is to the left or to the right of the minimum carrier return distance, which is determined by the count in the counter 72 being "*a*" − "*b*" + "*c*," necessary to insure sufficient velocity in order to be able to use the carrier return estimation scheme. The minimum carrier return distance is the movement of the carrier from right to left in FIG. 4*b* from the point 92 to the point 95 and then from left to right from the point 95 to the point 97. Thus, the minimum distances of the movements of the carrier are the intervals "*c*" and "*a*" in one direction and the interval "*b*" in the other direction. Therefore, the interval "*b*" is subtracted from the sum of the interval "*c*" and "*a*" to obtain the minimum mechanical distance that the carrier 5 must be from the print position (the point 97) at the time that the carrier return starts in order for the carrier 5 to have sufficient velocity at the point 97 to print.

If the carrier 5 is found to be too far to the left, this information is transmitted by a line 82 of FIG. 3, and the carrier 5 is moved to the right by a control block 86 prior to starting the carrier return function by energizing the carrier return magnet 156. If the carrier 5 is found to be far enough to the right, the carrier return is started immediately by a signal on a line 83 of FIG. 3 to the carrier return magnet 156. An example of the control block 86 is shown in FIG. 5 of U.S. Pat. No. 3,403,386 to Perkins et al.

Regardless of how the carrier return function is started, whether it be due to the carrier 5 being moved to the right or the carrier return function starting immediately, the carrier return magnet drop point is determined by the signals on cables 84 and 85 being equal. This comparison is made at a Compare No. 2 logic comparator 87. An example of the comparator 87 is a comparator shown on page 45 of Handbook Of Operational Amplifier Applications by Burr-Brown Research Corporation, copyright 1963.

As shown in FIG. 4*b*, the carrier return magnet drop point is at 89, and this is defined with respect to the point 97 in FIG. 4*b* by the mechanical distance "*a*" − "*b*" when LM, the left margin, is at zero count. As previously mentioned, the interval "*a*" is the mechanical distance that it takes for the carrier 5 to decelerate to zero velocity after the magnet 156 is dropped with the carrier 5 moving from right to left in FIG. 4*b* from the point 89, which is where the magnet 156 is de-energized, to the point 95. The interval "*b*" is the distance that the carrier 5 moves from left to right in FIG. 4*b* from the point 95 to the point 97 to have sufficient velocity to start to print. While the register 78 supplies the output of "*c*" − "*b*" + "*a*" to the Compare No. 1 logic comparator 79, the output on the cable 85 from the register 78 must be "*a*" - "*b*" since this is the position of the carrier 5 when the carrier return magnet 156 is deenergized at the point 89. If the left margin is at a count other than zero, this count must be added to the outputs supplied to the Compare No. 1 logic comparator 79 and the Compare No. 2 logic comparator 87.

As soon as an equal comparison is made at the Compare No. 2 logic comparator 87, the carrier return magnet 156 is dropped by an output to the magnet 156 from the Compare No. 2 logic comparator 87. This then completes the carrier return drop point based on the estimation scheme. Following the carrier return magnet drop, the carrier 5 free flights to zero velocity and reverses then in a forward direction to arrive at the first print position at sufficient velocity.

The following Algorithms and terminology are useful in the present system.

CARRIER RETURN ALGORITHMS

Definitions

1. LM — Left Margin
2. CP — Carrier Position
3. CPCLM — Carrier Position to the Left of the Left Margin
4. CRMIN — Minimum distance between carrier return pick and drop points for consistent turn-around distance
5. TURN — Measured distance from carrier return drop point to point which carrier reaches zero velocity
6. DELTAS — Free flight distance forward before printing
7. DELTAP — Minimum distance that carrier return can be picked and dropped when carrier turn-around is not a problem
8. CRCVT — Worst case distance that carrier return can be dropped and guarantee that the carrier will not hit the frame

ALGORITHMS

A. If CPCLM, tab to LM and index
B. If CP = LM, output index
C. LM < CRCVT

Case 1

$$CP \leqq LM + TURN - DELTAS + CRMIN$$

1. Tab to LM + TURN − DELTAS + CRMIN
2. Issue carrier return with drop point at LM + TURN − DELTAS
3. Drop escape magnet at LM

Case 2

$$CP > LM + TURN - DELTAS + CRMIN$$

1. Issue carrier return with drop point at LM + TURN − DELTAS
2. Drop escape magnet at LM

D. LM > CRCVT

Case 1

$$CP \leqq LM + TURN - DELTAS + CRMIN$$

$$CP - LM \geqq DELTAP$$

1. Issue carrier return with drop point at LM
2. Drop escape magnet at LM

Case 2

$$CP < LM + TURN - DELTAS + CRMIN$$

$$CP - LM < DELTAP$$

1. Issue tab to LM + DELTAP
2. Issue carrier return with drop point at LM
3. Drop escape magnet at LM Case 3

$$CP \geqq LM + TURN - DELTAS + CRMIN$$

1. Issue carrier return with drop point at LM + TURN − DELTAS
2. Drop escape magnet at LM.

Thus, algorithm A discloses that it is only necessary to tab to the left margin and index the document 7 to start to print when the carrier position is to the left of the left margin.

Algorithm B discloses that it is only necessary to index the document 7 if the carrier position is at the left margin. This is because printing begins at this left margin.

In all of the algorithms, it should be understood that the left margin is at some selected fixed distance from the left frame 102. Thus, algorithm C is concerned with a situation in which the selected fixed distance from the left margin to the left frame 102 is less than the interval "*a*" as represented by CRCVT since this represents the maximum necessary distance between dropping of the carrier return magnet 156 and the point 95 in FIG. 4*b*.

Accordingly, Case 1 of algorithm C is concerned with where the carrier position is less than or equal to the position defined by the distance of the left margin from the left frame 102 plus the interval "*a*" minus the interval "*b*" plus the interval "*c*." To insure that the carrier 5 will not strike the left frame 102, it is necessary to tab the carrier position to the right a distance equal to the distance of the left margin from the left frame 102 plus the interval "*a*" minus the interval "*b*" plus the interval "*c*" as indicated in Step 1 of Case 1. In Step 2, the carrier return drop point 89 of FIG. 4*b* is defined by the distance of the left margin plus the interval "*a*" minus the interval "*b*." This enables printing to occur at the left margin as indicated by Step 3 since the escape magnet 140 would be dropped at the left margin if printing was not occurring so as to stop the carrier 5 at the left margin.

As set forth in the Woods et al U.S. Pat. No. 3,831,728, there is always back spacing from the left margin whenever printing is to begin. Thus, it is necessary to drop the escape magnet 140, which stops the carrier 5, at the left margin so that back spacing at the start of a print cycle still results in printing beginning at the left margin.

In Case 2 of algorithm C, the carrier position is greater than the distance of the left margin from the left frame 102 plus the interval "*a*" minus the interval "*b*" plus the interval "*c*." Therefore, it is not necessary to carry out Step 1 of Case 2 of algorithm C for this location of the left margin. Accordingly, only Steps 2 and 3 of Case 1 if algorithm C occur in Case 2 of algorithm C, and these are identified as Steps 1 and 2.

In algorithm D, the distance of the left margin from the left frame 102 is greater than the maximum distance indicated by the interval "*a*" as represented by CRCVT. Thus, the point 89 of FIG. 4*b* could even be at the left margin without the carrier 5 impacting the left frame 102 during its deceleration movement through the interval "*a*."

In Case 1 of algorithm D, there are two requirements for the carrier position. First, the carrier position is less than or equal to the distance of the left margin from the left frame 102 plus the interval "*a*" minus the interval "*b*" plus the interval "*c*." Second, the difference between the carrier position and the left margin is equal to or greater than the minimum interval "*c*" when turn around is not a problem. In this case, it is only necessary to drop the magnet 156 at the left margin since there is sufficient distance between the left margin and the left frame 102 to enable the carrier 5 to go the remainder of the distance and still return to the left margin for print as is indicated by Step 2 in Case 1.

In Case 2 of algorithm D, the carrier position is closer to the left frame 102 than the distance of the left margin from the left frame 102 plus the interval "*a*" minus the interval "*b*" plus the interval "*c*." At the same time, the difference between the carrier position and the left margin is less than the minimum interval "*c*" when carrier turn around is not a problem. Accordingly, it is necessary to tab the carrier 5 to a position equal to the left margin plus the minimum interval "*c*" when carrier turn around is not a problem. Then, Steps 1 and 2 of Case 1 will be carried out as indicated by Steps 2 and 3 of Case 2.

In Case 3 of algorithm D, the carrier position is equal to or greater than the distance of the left margin from the left frame 102 plus the interval "*a*" minus the interval "*b*" plus the interval "*c*." This location of the carrier 5 is such that the carrier return drop magnet 156 can be dropped at the distance of the left margin from the left frame 102 plus the interval "*a*" minus the interval "*b*" as indicated by Step 1. This results in printing beginning at the left margin as indicated by Step 2.

Thus, the algorithms show that turn around is accomplished with the present invention without any problem of the carrier 5 engaging the left frame 102 while still obtaining turn around in a minimum period of time. At the same time, printing starts at the left margin.

While the invention has been particularly shown and described with reference to a preferred embodiment, it will be understood by those skilled in the art that various changes in form and detail may be made without departing from the spirit and scope of the invention.

What is claimed is:

1. Printing apparatus for printing information on a document during relative movement of said document and a print head assembly, wherein said relative movement involves movement of said assembly between left and right margin locations, printing of information occurring during a relative forward movement toward one of the left and right margin locations with printing of information beginning at the other of the left and right margin locations, and non-printing occurring during a relative return movement toward the other of the left and right margin locations, and said assembly going through a turn around interval representing a physical change in direction of relative movement between said document and said print head assembly from when said assembly starts to decelerate during relative return movement to the beginning of printing of information during relative forward movement, comprising:

test means for establishing a test mode of operation of said apparatus to determine the optimum point of initiation of said turn around interval to minimize the time required for said turn around interval to increase the time available for printing of information;

said test means includes storage means for storing data representative of said optimum point;

and means to initiate said turn around interval during printing operations in accordance with the data in said storage means.

2. The apparatus according to claim 1 in which said test means includes:

assembly location determining means for determining the location of said assembly relative to the other location of said left and right margin locations;

and said initiating means includes:

first means responsive to said assembly location determining means to cause movement of said assembly further toward the one location of said left and right margin locations if said assembly is not far enough from the other location of said left and right margin locations to insure turn around action for establishing a minimum velocity to print when an assembly return operation is initiated;

and second means responsive to said assembly location determining means to cause immediate initiation of an assembly return action if said assembly is far enough from the other location of said left and right margin locations to insure turn around action for establishing a minimum velocity to print when an assembly return operation is initiated.

3. The apparatus according to claim 2 including:

first comparing means to produce a signal to cause one of said first and second responsive means to be responsive to said assembly location determining means when an assembly return operation is initiated;

and second comparing means for developing a signal to initiate said turn around interval.

4. The apparatus according to claim 3 in which:

said assembly location determining means includes a grating and an associated counter network for maintaining and providing outputs of a count representation indicative of the actual location of said assembly relative to said document;

said storage means includes a register for storing and providing outputs of a count representation indicative of the sum of a count value indicative of the distance for deceleration movement of said assembly to zero during relative return movement following initiation of said turn around interval and the difference between a count value indicative of the distance for the minimum accelerating movement of said assembly during relative return movement prior to initiation of said turn around interval and a count value indicative of the distance for accelerating movement of said assembly during relative forward movement to a minimum velocity for printing;

and means for applying outputs from said counter network and said register to said first comparing means.

5. The apparatus according to claim 4 in which said test means includes:

an assembly de-activating switch positioned for activation by said assembly during relative return movement;

and initializing means operable in conjunction with said switch during a test cycle for activating said counter network to develop a count value representative of the distance for deceleration movement of said assembly during relative return movement following initiation of said turn around interval.

6. The apparatus according to claim 5 in which the print head assembly is an ink jet print head assembly.

7. The apparatus according to claim 4 in which the print head assembly is an ink jet print head assembly.

8. The apparatus according to claim 3 in which the print head assembly is an ink jet print head assembly.

9. The apparatus according to claim 2 in which the print head assembly is an ink jet print head assembly.

10. Ink jet printing apparatus for printing information on a document by relative movement of said document and an ink jet print head assembly mounted on a carrier, wherein said relative movement involves movement of said assembly and carrier between left and right margin locations, printing of information occurring during a relative forward movement toward one of the left and right margin locations with printing of information beginning at the other of the left and right margin locations, and non-printing occurring during a relative return movement toward the other of the left and right margin locations, and said assembly going through a turn around interval representing a physical change in direction of relative movement between said document and said print head assembly from when said assembly starts to decelerate during relative return movement to the beginning of printing of information during relative forward movement, comprising:

test means for establishing a test mode of operation of said ink jet printing apparatus to determine the optimum point of initiation of said turn around interval to minimize the time required for said turn around interval to increase the time available for printing of information;

said test means includes storage means for storing data representative of said optimum point;

and means to initiate said turn around interval during printing operations in accordance with the data in said storage means.

* * * * *